US008459082B2

(12) United States Patent
Göggel et al.

(10) Patent No.: US 8,459,082 B2
(45) Date of Patent: Jun. 11, 2013

(54) SYSTEM FOR CHANGING A ROLLER

(75) Inventors: Tobias Göggel, Veringenstadt (DE); Helmut Hörmann, Donaueschingen (DE)

(73) Assignee: Siemens Aktiengesellschaft, Munich (DE)

( * ) Notice: Subject to any disclaimer, the term of this patent is extended or adjusted under 35 U.S.C. 154(b) by 625 days.

(21) Appl. No.: 12/602,810

(22) PCT Filed: Jun. 4, 2008

(86) PCT No.: PCT/EP2008/056861

§ 371 (c)(1),
(2), (4) Date: Dec. 3, 2009

(87) PCT Pub. No.: WO2008/148767

PCT Pub. Date: Dec. 11, 2008

(65) Prior Publication Data

US 2010/0175239 A1 Jul. 15, 2010

(30) Foreign Application Priority Data

Jun. 6, 2007 (DE) ..... 10 2007 026 400

(51) Int. Cl.
*B21B 31/00* (2006.01)
*B21B 31/08* (2006.01)

(52) U.S. Cl.
USPC ..... 72/237; 72/236; 72/239

(58) Field of Classification Search
USPC ..... 72/237, 238, 239; 164/441, 442
See application file for complete search history.

(56) References Cited

U.S. PATENT DOCUMENTS

| | | | | |
|---|---|---|---|---|
| 4,685,390 | A * | 8/1987 | Pav et al. | 72/239 |
| 6,053,020 | A | 4/2000 | Tiepelmann et al. | 72/239 |
| 7,471,198 | B2 | 12/2008 | Yamamoto et al. | 340/572.1 |
| 2002/0078728 | A1 | 6/2002 | Mukaigawa et al. | 72/239 |
| 2005/0000263 | A1 | 1/2005 | Wittkopf | 72/239 |

FOREIGN PATENT DOCUMENTS

| | | | |
|---|---|---|---|
| DE | 4217049 | A1 | 11/1993 |
| DE | 19747013 | A1 | 4/1999 |
| DE | 10112512 | A1 | 9/2002 |

(Continued)

OTHER PUBLICATIONS

International PCT Search Report, PCT/EP2008/056661, 11 pages, Aug. 8, 2008.

(Continued)

*Primary Examiner* — Teresa M Ekiert
(74) *Attorney, Agent, or Firm* — King & Spalding L.L.P.

(57) ABSTRACT

A system for changing a roller, has a system for determining parameters which characterize the identity and/or the operating state of a roller of an industrial plant, at least one sensor arranged on the roller for furnishing parameters being designed such that the furnished identity parameter of the roller is detectable, and a reading device designed for reading out detected parameters from the sensor without contact. The sensor is also designed to detect an operation state parameter of the roller and can be operated at a roller temperature of at least 150 C. In a rollerchanging wagon on which a roller can be mounted in such a manner that the roller can be guided into or out of a roll stand, the sensor is arranged on the roller for the purpose of furnishing and/or detecting parameters. The process security for an industrial plant can be increased by such a system.

20 Claims, 4 Drawing Sheets

FOREIGN PATENT DOCUMENTS

| | | | |
|---|---|---|---|
| DE | 10125292 | A1 | 11/2002 |
| DE | 10138588 | A1 | 2/2003 |
| DE | 202005013642 | U1 | 10/2005 |
| DE | 112004001668 | T5 | 7/2006 |
| SU | 59719 | A | 1/1941 |
| SU | 768504 | A2 | 10/1980 |
| SU | 984052 | A | 12/1982 |
| SU | 1285588 | A | 1/1987 |

OTHER PUBLICATIONS

German Office Action, German application No. 10 2007 026 400.5-51, 4 pages, Jan. 11, 2008.

* cited by examiner

SYSTEM FOR CHANGING A ROLLER

CROSS-REFERENCE TO RELATED APPLICATIONS

This application is a U.S. National Stage Application of International Application No. PCT/EP2008/056861 filed Jun. 4, 2008, which designates the United States of America, and claims priority to German Application No. 10 2007 026 400.5 filed Jun. 6, 2007, the contents of which are hereby incorporated by reference in their entirety.

TECHNICAL FIELD

The invention relates to a system for changing a roller.

BACKGROUND

Systems for changing rollers are nowadays needed to replace rollers in a short amount of time if they no longer meet the requirements imposed on them. The need to change rollers is high, in particular, in rolling mills.

Systems for changing a roller in an industrial installation, in particular in a rolling mill, are nowadays frequently based on manual activities, for example detecting the roller identifier, and actions derived there from. However, such roller changing operations are highly prone to error. In a rolling mill, for example, this may result in rollers with "incorrect" properties being inserted into a rolling stand. This has a disadvantageous effect on the material for rolling rolled using the latter. The situation in which rolled material cannot be used further and must be melted down in the steelworks again may even result.

SUMMARY

According to various embodiments, a system can be provided which increases process reliability in rolling processes.

According to an embodiment, a system for changing a roller, may have a system for determining parameters which characterize the identity and/or the operating state of a roller of an industrial installation, may have at least one sensor which is arranged on the roller, is intended to store parameters and is configured in such a manner that a stored identity parameter of the roller can be detected, may have a reading device which is designed to contactlessly read detected parameters from the sensor, the sensor also being configured to detect an operating state parameter of the roller and being able to be operated at a roller temperature of at least 150° C., and may have a roller changing carriage on which a roller which can be inserted into a rolling stand or removed from the rolling stand can be mounted, the sensor for storing and/or detecting parameters being arranged on the roller.

According to a further embodiment, the reading device can be arranged on the roller changing carriage. According to a further embodiment, the roller changing carriage may comprise a gripper carriage on which the reading device is arranged. According to a further embodiment, the sensor can be arranged on an end face of the roller or on the bearing of the roller. According to a further embodiment, the system may comprise a data evaluation device which can be supplied with read parameters of the rollers involved in the changing operation. According to a further embodiment, the data evaluation device may check whether the roller which has been inserted or is to be inserted into a particular rolling stand can be operated as planned with this particular rolling stand, in particular on the basis of a product to be produced. According to a further embodiment, the operating state parameter can be detected by means of measurement. According to a further embodiment, an operating state parameter can be the temperature of the roller. According to a further embodiment, an operating state parameter can be an oscillation frequency and/or an oscillation amplitude of the roller. According to a further embodiment, the reading device can supply energy for operating the sensor to the sensor. According to a further embodiment, the reading operation can be effected using electromagnetic radiation. According to a further embodiment, the sensor can be designed in such a manner that a plurality of parameters can be detected together. According to a further embodiment, the arrangement of the at least one reflector may determine an identification parameter. According to a further embodiment, a first roller may have a first surface acoustic wave sensor and a second roller may have a second surface acoustic wave sensor, the reflectors of the first and second surface acoustic wave sensors being arranged in such a manner that the signals which are associated with the read parameters of the first roller and the read parameters of the second roller do not overlap in terms of time when simultaneously reading the sensors.

BRIEF DESCRIPTION OF THE DRAWINGS

Further advantages of the invention emerge from exemplary embodiments which are diagrammatically illustrated in the drawings and are explained in more detail below using the figures, in which.

DETAILED DESCRIPTION

Figure 1:
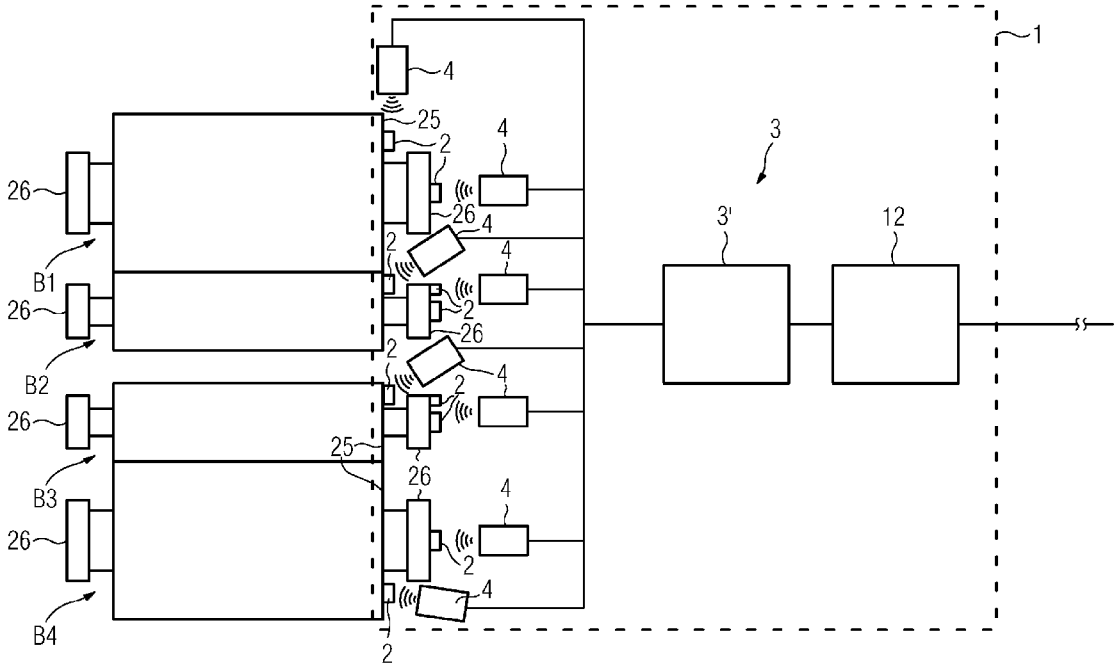
FIG. 1 shows a system for determining parameters.

According to various embodiments, a system for changing a roller, may have a system for determining parameters which characterize the identity and/or the operating state of a roller of an industrial installation, at least one sensor which is arranged on a roller, is intended to store parameters and is configured in such a manner that a stored identity parameter of the roller can be detected, a reading device which is designed to contactlessly read detected parameters from the sensor, the sensor also being configured to detect an operating state parameter of the roller and being able to be operated at a roller temperature of at least 150° C., and a roller changing carriage on which a roller which can be inserted into a rolling stand or removed from the rolling stand can be mounted, the sensor for storing and/or detecting parameters being arranged on the roller. As a result of such a system for changing a roller, errors are avoided when replacing rollers or errors are found more quickly in the case of a roller changing operation which has already been carried out. Reading identity parameters allows rollers to be uniquely identified at any time and allows the properties of the latter to be clearly ascertained on the basis of the determined identity. If necessary, the properties of a roller may be directly stored in the sensor arranged on the roller. Alternatively, the property of a roller may be determined using a database in which particular properties are respectively associated with particular rollers.

The use of a system for determining a parameter makes it possible to improve process monitoring for an industrial process, in particular a rolling process in a rolling mill. This is because, on the one hand, data are contactlessly transmitted between the sensor and the reading device, as a result of which the detection of parameters is made more flexible. On the other hand, operating state parameters of the roller can be detected and read. The information relating to the roller is thus extended by current data which are associated with the operating state of the roller and cannot be provided by RFID tags, for example. It is now no longer only possible to read information already stored in the sensor but it is additionally possible to detect the operating state parameters of a roller which are variable depending on boundary conditions.

Within the scope of this application, identification parameters are understood as meaning all information and data which are deliberately stored in a sensor in order to be able to subsequently read them using a reading device. In particular, the identification parameters comprise all stored data which allow unique identification of the roller on which the sensor is arranged. The identification parameters may be, for example, historical data of the roller, for example production date of the roller, manufacturer of the roller, intended areas of use and/or service life of the roller. Furthermore, operating parameters, for example tolerance range of physical variables such as temperature, pressure, etc., for the roller may also be considered to be identification parameters. Identification parameters may be adjustable, that is to say can be stored in the sensor such that they can be changed, or may have been set, that is to say have been established and fixed in the sensor once.

Operating state parameters are distinguished by the fact that they represent or characterize the current operating state of a roller. An operating state is not stored in the sensor but rather is first of all detected by the sensor, for example by means of measurement or in some other manner, for instance calculation.

According to various embodiments, operating state parameters can be detected even under adverse conditions, for instance high temperatures, as can be found in industrial installations. However, these adverse conditions do not result in the system for changing rollers being prone to error. Rather, the roller changing system is designed to be so robust that it also operates under these adverse conditions. Such adverse conditions can be found, in particular, in the metal-processing industry, for instance steelworks or rolling mills. This is because operating temperatures of the sensor of more than 200° C. occur here depending on the type and function of the roller and depending on the positioning of the sensor on the roller of a steelworks or rolling mill. Therefore, the sensor is preferably configured in such a manner that it can be permanently operated in a temperature range of 150° C. to 350° C. or 200° C. to 350° C. It is particularly advantageous if the sensor is configured in such a manner that it can be permanently operated in a temperature range of 150° C. to 1000° C. Permanent operation of conventional RFID sensors is nowadays not possible in this temperature range.

The rollers provided with the sensor should preferably be replaced frequently, for example on account of wear, since the advantages of the various embodiments become particularly apparent under such circumstances. This is because errors when changing rollers during a required roller replacement can be reduced by means of the various embodiments since the identity of the roller can be uniquely and simply determined using the sensor. Furthermore, operating state parameters can be detected in a particularly simple manner during operation of the roller according to various embodiments. This allows relationships to be established between the behavior of the roller during operation, for instance wear, and the operating state parameters. This can be used to improve or optimize roller operation.

Industrial installations are understood as meaning any facility intended for industrial manufacture or industrial service. These may be, for instance, industrial laundry services, steelworks and rolling mills, chemical industrial installations, industrial installations in primary industry, in particular industrial installations for manufacturing paper, or any desired other industrial facilities.

The reading device for contactlessly reading the sensor may be mobile or stationary. In particular, the reading device may be in the form of a mobile handheld device. This is particularly advantageous if, for example, sensors on rollers in a roller grinding mill or roller bearing are intended to be read by staff. Alternatively, the reading device may be arranged on rollers of the industrial installation in such a manner that the sensor can be read in a contactless manner. In particular, the reading device may be arranged such that it can be moved relative to the sensor.

According to a further embodiment, the reading device is arranged on the roller changing carriage. Since, in the event of a roller changing operation, the rollers are generally placed on the roller changing carriage anyway, the rollers can be identified in a particularly simple manner there. As a result of the fact that the reading device is arranged on the roller changing carriage, the reading device may also be arranged in such a manner that it is protected, if necessary. Furthermore, there is no need for any additional mobile reading devices, thus reducing the amount of space required.

The roller changing carriage advantageously comprises a gripper carriage on which the reading device is arranged. The gripper carriage is used to insert the roller into the rolling stand and to remove the roller from the rolling stand. During insertion and removal, the gripper carriage is positioned relatively close to the roller. Therefore, the sensor can be read in a simple manner and without errors using a reading device arranged on the gripper carriage. It is therefore possible to use electromagnetic waves with a short range to read the sensor, in particular when the reading device is arranged on the gripper carriage.

In one embodiment, the sensor is arranged on an end face and/or on the bearing of the roller. The end face of the roller is subjected to only relatively low stresses in comparison with the lateral surface of the roller. Furthermore, a sensor arranged on the end face or on the bearing of the roller can be accessed in a particularly simple manner even during operation of the roller. The smallest disturbances generally occur here when contactlessly reading the sensor.

The roller changing system preferably comprises a data evaluation device which can be supplied with read parameters of the rollers involved in the changing operation. The reading device according to various embodiments can be used to uniquely identify each roller by means of an identification parameter. This in turn allows unique properties to be associated with the identified roller using the data evaluation device, for example using a concordance list. According to a further embodiment, the data evaluation device checks whether the roller which has been inserted or is to be inserted into a particular rolling stand can be operated as planned with this particular rolling stand, in particular on the basis of a product to be manufactured. The data evaluation device preferably therefore also stores information relating to rolling stands, in particular which rollers can be operated in particular rolling stands, in particular with regard to a product to be manufactured. A roller changing carriage is generally associated with a particular rolling stand. If the identity of the roller and, if necessary, the identity of the rolling stand are now determined using the reading device arranged on the roller changing carriage, the data evaluation device can be used to determine whether the roller and the rolling stand are intended to be operated together as planned. Since only particular rollers can be operated in particular rolling stands in order to avoid changing the properties of the product—of the material for rolling, for example a metal strip—in an undesirable manner, the data evaluation device is used to check whether the roller mounted on the roller changing carriage and intended to be changed has the corresponding properties. A set of rollers, for example comprising two working rollers, is generally changed simultaneously. If the data evaluation device is now used to determine that a roller which is not intended for a particular rolling stand has been mounted on a roller changing carriage associated with the stand, the data evaluation device can emit a signal to a monitoring control center. The latter may then initiate corresponding measures. If necessary, the data evaluation device may cause the identified roller with "incorrect" properties on the particular roller changing carriage to be replaced with a roller with "correct" properties in a fully automated manner. A roller with corresponding properties for the roller changing carriage can thus be provided, if necessary before a roller changing operation takes place or before the product is damaged. The data evaluation unit is therefore preferably designed at least to manage the roller stock, in particular during the roller changing operation. The data evaluation device automatically detects which rollers are removed from the rolling stand and which rollers are inserted into the rolling stand for operation. The data evaluation device therefore checks the rollers in and out and thus documents roller changing operations. The data evaluation device therefore always stores which rollers are currently in operation. If necessary, the transporting devices, for instance cranes or roller transporting carriages, are also provided with reading devices, with the result that it is also possible to track the location of rollers which have been removed from the rolling stand in the rolling mill. The data evaluation device can therefore also track the location of rollers.

According to a further embodiment, the operating state parameter can be detected by means of measurement. Detecting current operating state parameters of the roller using metrology advantageously combines two data acquisition principles. On the one hand, at least one operating state parameter can be read from the sensor at any time in a technically simple manner. On the other hand, the roller can be identified at any time on the basis of the stored identification parameters using the reading device. Series of measurements for the operating state parameters can therefore be specifically recorded, for example, for particular rollers and can be related, for example, to the quality of a product in which the roller is/was involved. This knowledge can be used to improve the industrial process. The temperature of the roller, the oscillation state of the roller, that is to say the oscillation frequency and/or oscillation amplitude of the roller, the position of the roller or the humidity of the roller environment can be detected, in particular, as measured operating state parameters by means of measurement. In the case of rolling stands in particular, it is advantageous to arrange sensors on the rolling stand, on the working roller and on the stand drives, which sensors detect the oscillation state of the respective roller. Detecting the oscillation state of the respective rollers makes it possible to determine which roller is assigned an exciter function for the resultant stand oscillations which are disadvantageous when manufacturing metal products. Quickly locating the oscillation exciter makes it possible to act quickly in order to keep rejects of the production items, for example a metal strip—caused by the stand oscillations—as low as possible.

According to a further embodiment, the reading device can supply energy for operating the sensor to the sensor. There is therefore no need to provide the sensor with an energy source which ensures the operation of the latter. Rather, the sensor operates only when the reading device emits a signal to read the sensor. As a result, the sensor can also be compact and have a low weight.

According to a further embodiment, the sensor is read using electromagnetic radiation. The use of electromagnetic radiation resorts to understood and established technology and is therefore reliable and easy to manage. A transmission power which is free of national licensing procedures is preferably provided for the reading device. This is currently 100 mW (milliwatts) in Europe. However, this may be subject to changes. In this case, data are preferably transmitted in a frequency range of 2.4 GHz (gigahertz) to 2.4835 GHz, that is to say the ISM (Industrial, Scientific, Medical) range. In order to avoid interference with other wireless communication systems, for instance WLAN-based systems, the reading device and/or the sensor may be designed in such a manner that the traffic between them operates only at a short distance, that is to say less than 1 meter, in particular in a range of 30 cm to 80 cm. Furthermore, the reading device may comprise, for example, a directional antenna which emits a signal to read the sensor essentially in the direction of the latter. In particular, energy for operation can be advantageously supplied to an electrically passive sensor using electromagnetic radiation or electromagnetic waves.

According to yet a further embodiment, the sensor is designed in such a manner that a plurality of parameters can be detected together. For example, a plurality of identification parameters, a plurality of operating state parameters or a combination of identification parameters and operating state parameters are therefore transmitted by means of a single signal response from a sensor. The signal response comprises, for example, the detected operating state parameters and the identification parameters. In this case, the basis for the signal response is, for example, the signal corresponding to an identification parameter. The signal associated with the identification parameter is, for example, modified in a defined manner by the operation of measuring an operating state parameter in such a manner that the change in the signal corresponding to the identification parameter represents the operating state parameter. As a result, the data transmission volume and thus the absolute error in the data transmission operations can be kept low.

In one embodiment, the sensor is in the form of a surface acoustic wave sensor having a receiving and transmitting unit, having a signal converter which is arranged on a piezoelectric crystal and is intended to reciprocally convert surface acoustic waves and electrical signals, and having at least one reflector for reflecting surface acoustic waves. This is a particularly temperature-stable sensor which can be operated up to 350° C. and, in a particular refinement, even up to 1000° C. using heat-resistant ceramics. The receiving/transmitting unit is generally an antenna which receives signals, in particular electromagnetic waves, from the reading device. These are converted into surface acoustic waves by the signal converter and the piezoelectric crystal. The surface acoustic waves propagate on the surface of the piezoelectric crystal. Furthermore, at least one reflector for reflecting surface acoustic waves is arranged on the piezoelectric crystal. A plurality of reflectors, for example two or three, are preferably provided. Up to 20 reflectors may also be provided for each surface acoustic wave sensor. The surface acoustic waves generally partially reflected at the at least one reflector run back to the signal converter and are converted back into electromagnetic signals there. The electromagnetic signals obtained from the surface acoustic waves are then emitted via the antenna of the sensor and are received by the reading device. Each sensor can be individually or uniquely configured in this manner by suitably arranging the reflectors on the piezoelectric crystal.

In one embodiment, the arrangement of the at least one reflector determines an identification parameter. Unique roller identification parameters can be provided for each sensor by arranging the reflectors on the piezoelectric crystal. The identity is provided in this case by characteristic propagation times or propagation time differences of the signals between the signal converter and the at least one reflector. At least one identification parameter from the identification parameters read then allows the identity of the roller to be uniquely determined from the read identification parameters in a reversible manner. At the same time, however, the surface acoustic wave sensor also enables a temperature measurement and an oscillation measurement since the propagation time of the surface acoustic wave generated by the signal converter is dependent on the temperature and the oscillation state of the piezoelectric crystal. In addition to a unique roller identification parameter, operating state parameters which are detected by the sensor and are in the form of the temperature and the oscillation state can therefore also always be read out without any additional effort in the case of such a sensor. In one embodiment, a first roller has a first surface acoustic wave sensor and a second roller has a second surface acoustic wave sensor, the reflectors of the first and second surface acoustic wave sensors being arranged in such a manner that the signals which are associated with the read parameters of the first roller and the read parameters of the second roller do not overlap in terms of time when simultaneously reading the sensors. It is thus possible to read a plurality of, that is to say at least two, sensors at the same time using a single reading device and nevertheless to uniquely associate the signals with a respective sensor and thus the respective roller. This further improves the transmission of data since the amount of effort needed to read the sensors is reduced. This is particularly advantageous when reading mounted rollers since the time needed to detect the mounted rollers in the roller bearing can be shortened here.

Another embodiment provides a data processing device which can be supplied with parameters which have been read. The data processing device is supplied with the detected operating state parameters which have been read and the identification parameters which have been read. This produces a stock of data which can be individually resorted to for each roller for regulating purposes, control purposes or documentation purposes. The data processing device is preferably supplied with further operating state parameters of the roller which are not or cannot be detected using the sensor as well as a multiplicity of further variables influencing the process. Data relating to the manufacture of the product or data relating to the product manufactured are preferably also supplied to this data processing device. Currently detected operating state parameters can be used to regulate, control or optimize the roller or roller operation by determining relationships, for example in the form of a process model, between operating state parameters and product properties of the product manufactured. A roller is preferably optimized offline with respect to the process activity, for example after changing or removing the roller. Regulation and/or control of the rollers on the basis of the operating state parameters which have been detected and read is/are preferably carried out during operation of the roller, that is to say online. Successive read operating state parameters in conjunction with read identity parameters can be included directly in a process model, for example, and can be used to regulate the roller manipulated variables. This makes it possible to improve product quality.

FIG. 1 shows a system 1 for determining parameters of different rollers B1, B2, B3 and B4 of a rolling mill, B1 and B4 being in the form of supporting rollers with bearings 26, and B2 and B3 being in the form of working rollers with bearings 26 in FIG. 1. It is noted that the drive-side drive segments for driving the working rollers are not illustrated in FIG. 1 since they are not essential to the invention. The system 1 for determining parameters comprises an evaluation device 3 having a reading control unit 3' and antennas 4 controlled by this reading control unit 3'. The system 1 for determining parameters also comprises sensors 2 arranged on the rollers B1, B2, B3 and B4.

The sensors 2 are in the form of surface acoustic wave sensors. An identification parameter which is individual for each roller B1, B2, B3 and B4 is respectively stored in the surface acoustic wave sensors. This parameter can be read using the reading device 3. In addition, the respective sensors 2 can be used to detect operating state parameters, namely the temperature and the oscillation state of the respective roller B1, B2, B3 and B4. The sensors 2 are arranged on the roller B1 at different locations. In order to easily identify the rollers B1, B2, B3 and B4, particular sensors 2 are arranged in such a manner that they can be addressed or read by the antennas 4 in a particularly simple manner. For this purpose, these particular sensors 2 are arranged on the bearing 26 of the working and supporting rollers or on "outer" end faces (not illustrated in FIG. 1) of the working rollers or supporting rollers.

Furthermore, sensors 2 are arranged on the rollers B1, B2, B3 and B4 on an "inner" end face 25 of the respective supporting roller or working roller. These sensors 2 are used to detect the temperature of the working rollers B2, B3 as close as possible to the lateral surface which interacts with the metal strip or, in the case of the supporting rollers B1 and B4, to detect the temperature of the supporting roller B1 or B4 as close as possible to the contact surface between the working roller B2 or B3 and the supporting roller B1 or B4.

The sensors 2 illustrated in FIG. 1 are passive sensors, that is to say they do not have their own energy supply. The sensors 2 are operated using the electromagnetic field emitted by the respective antenna 4. As a result of the energy supplied to the sensors 2, the operating state parameters of temperature and/or oscillation state can be detected and are sent back to the antenna 4 together with the stored identification parameter. The antenna 4 supplies the signals to the reading control unit 3' which converts the signals supplied by the antenna 4 into identification parameters or operating state parameters.

The sensors 2 are preferably read continuously, that is to say the operating state parameters of the rollers B1, B2, B3 and B4 are preferably detected at short intervals of time over a relatively long period of time. The operating state parameters which have been read are associated with the identification parameters in the reading device 3, with the result that a temporal profile of the operating state of a roller which can be uniquely identified using the identification parameter, for example B1, is stored in a data processing device 12.

Identification parameters and operating state parameters of a multiplicity of rollers of an industrial installation are preferably read and supplied to the data processing device 12.

The data processing device 12 can be additionally supplied with further information which was not determined using the system 1 for determining parameters. The data stored in the data processing device 12 then allow relationships to be established between different variables of an industrial installation. For example, the wear of rollers can be determined on the basis of the operating state parameters for each roller. This determined relationship can then be used to determine operating conditions of the roller which ensure a longer service life of the roller. The dependence of the product quality of the product manufactured, for example a metal strip which is produced by the working and supporting rollers, on the operating state parameters of the respective roller can also be determined. This makes it possible to improve production processes in an industrial installation.

The system 1 for determining parameters is preferably connected to an automation system of an industrial installation. The data in the data processing device 12 can preferably also be interrogated by a control center and can be processed further, for example displayed, inter alia.

Figure 2:
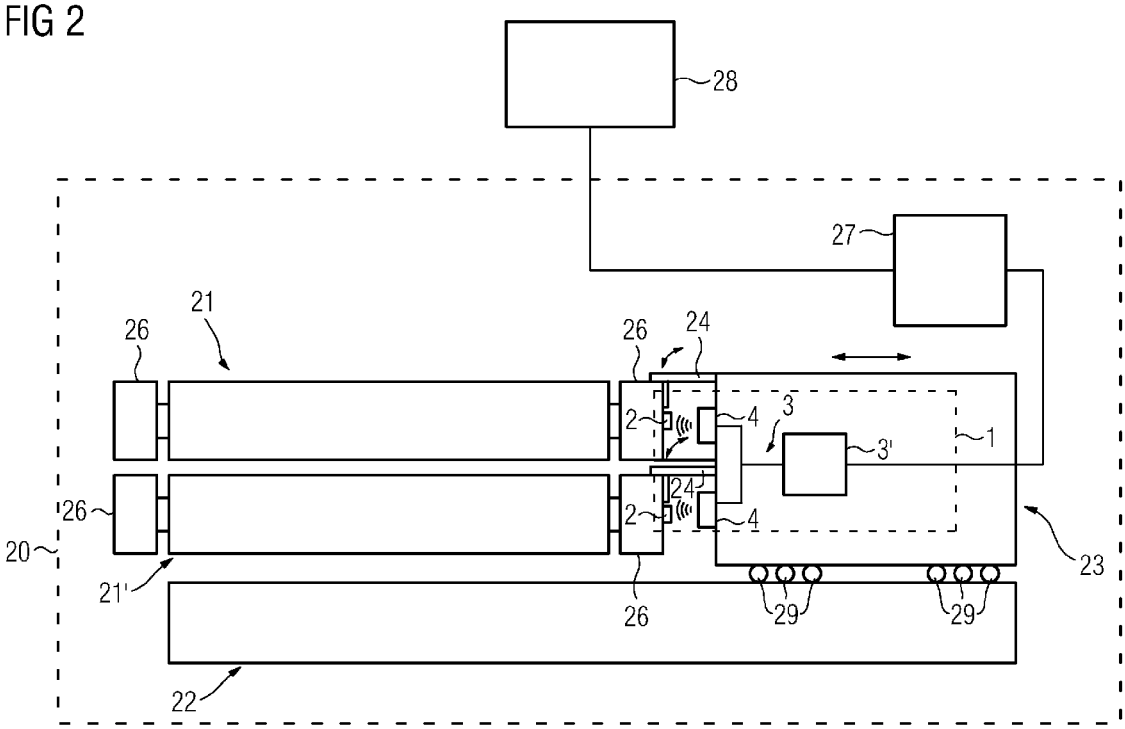
FIG. 2 shows a system for changing a roller.

FIG. 2 shows a system 20 for changing a roller or rollers or for changing a set of rollers. The system 20 for changing a roller comprises a roller changing carriage 22 on which a roller or a set of rollers can be mounted. In FIG. 2, a first working roller 21 and a second working roller 21' are mounted on the roller changing carriage 22. It is noted that the drive-side drive segments for driving the working rollers 21 and 21' are not illustrated in FIG. 2 since they are not essential to the invention. The working roller 21 and the working roller 21' together form the set of rollers. Said rollers are intended to be inserted into a rolling stand (not illustrated) which has already been prepared, that is to say freed from working rollers.

The system 20 for changing a roller or a set of rollers also comprises a gripper carriage 23 which is mounted in a displaceable manner on rolling elements 29, with the result that it can remove rollers or a set of rollers from a rolling stand and can insert rollers or a set of rollers into a rolling stand. For this purpose, the gripper carriage has two grippers 24 which can be used to guide the working rollers 21 and 21'.

The working rollers 21 and 21' which form the set of rollers each comprise two bearings 26.

A sensor 2 is respectively arranged on the bearings 26 of the respective working roller 21 and 21'. The sensors 2 are respectively designed to store identification parameters and to detect operating state parameters. The sensors 2 are preferably arranged on those bearings 26 of the rollers 21 and 21' which face the gripper carriage 23. The gripper carriage 23 comprises a reading device 3 for reading the sensors 2. For this purpose, two antennas 4 which are opposite the respective sensor on the bearing 26 of the working roller 21 or 21' are arranged on the gripper carriage 23. The antennas 4 are connected to a reading control unit 3' which is included in the reading device 3 and in which the signals which have been read from the sensor 2 are processed further. The roller changing carriage 22 thus comprises a system 1 for determining parameters which characterize the identity and/or the operating state of a roller if rollers having sensors 2 arranged on them are mounted on the roller changing carriage 22. The parameters which have been read can be supplied to a data evaluation device 27 which automatically manages the operation of changing rollers.

Reading the identification parameters in the case of rollers to be removed from a rolling stand and reading the identification parameters of the rollers to be inserted into a rolling stand makes it possible to automatically detect which rollers are currently in a particular rolling stand. Since each roller changing carriage 22 is associated with a particular rolling stand, there is generally no need to additionally identify the rolling stand by means of a system 1 for determining parameters if the respective roller changing carriage is known. However, this may be additionally provided.

Furthermore, the identification parameters of rollers can be matched with concordance lists in the data evaluation device 27. The concordance lists define, for example, which properties the working rollers or supporting rollers of a particular rolling stand may have in order to operate the latter as planned in such a manner that the product manufactured has properties which are within the intended specification. The concordance lists likewise store properties for rollers which can be uniquely identified. If the system 1 for determining parameters is now used within the system 20 for changing a roller or a set of rollers to determine, by means of a match in the concordance list, that a roller or set of rollers which has been mounted on the roller changing carriage 22 does not have the properties needed to operate the rolling stand in a fault-free manner or to manufacture the product in the desired quality, the data evaluation device 27 preferably transmits a signal, in particular a warning signal, to a monitoring control center 28. The monitoring control center 28 is preferably the control center of the industrial installation. A replacement of the rollers mounted on the roller changing carriage 22 can then be initiated there, with the result that production is not interrupted or the product manufactured is not damaged. Alternatively, the data evaluation device 27 can initiate fully automatic replacement of the set of rollers on the roller changing carriage.

Figure 3:
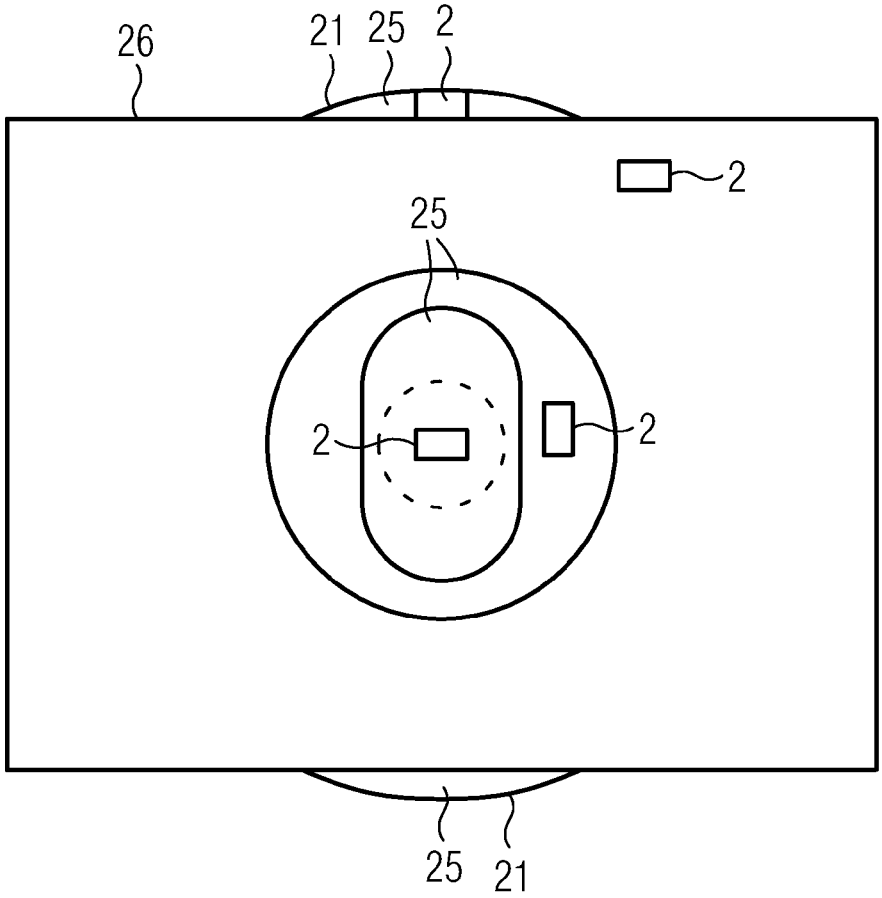
FIG. 3 shows a side view of a roller with a bearing.

FIG. 3 shows a side view of a roller 21 with a bearing 26. In particular, FIG. 3 shows which exemplary possibilities exist for fitting sensors 2 to the bearing 26 or the roller 21. Parts of the roller 21 penetrate the bearing 26 and can be used to arrange the sensor 2 on an end face 25 of the roller 21. For particularly good detection of the temperature of the roller 21, it is advantageous to arrange the sensor 2 as close as possible to that lateral surface of the roller 21 which is in contact with the material for rolling. This is illustrated in FIG. 3 by virtue of a sensor 2 being arranged on that end face 25 of the roller 21 which is arranged behind the bearing 26. FIG. 3 shows only possible exemplary embodiments which can be modified by a person skilled in the art within the scope of the arbitrary refinement of the reading device 3 which reads a sensor 2.

Figure 4:
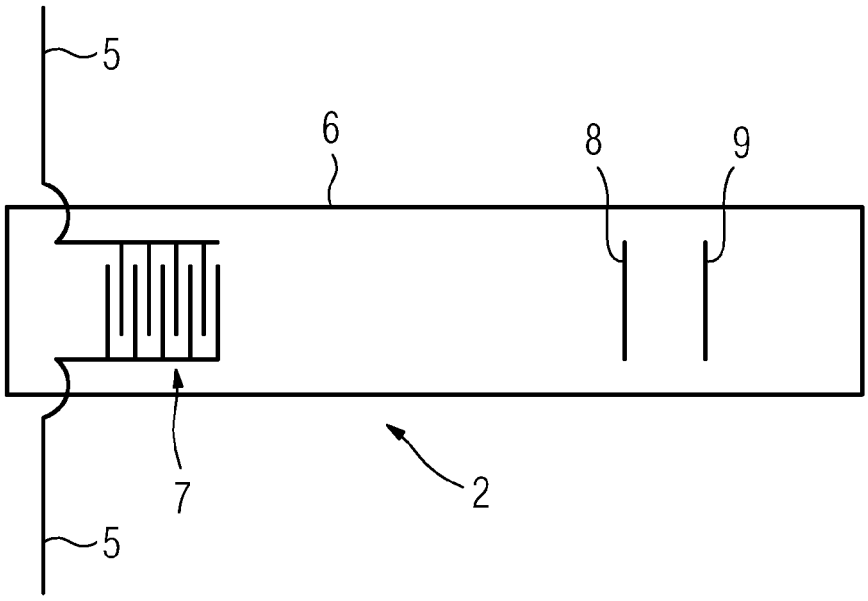
FIG. 4 shows a first surface acoustic wave sensor.
Figure 5:
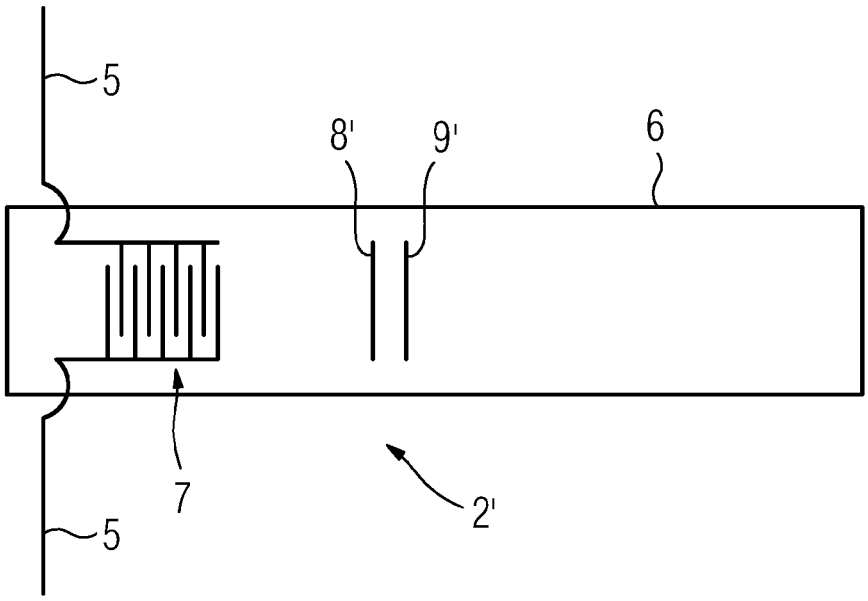
FIG. 5 shows a second surface acoustic wave sensor.

FIG. 4 shows a first surface acoustic wave sensor 2 and FIG. 5 shows a second surface acoustic wave sensor 2'. The first surface acoustic wave sensor 2 and the second surface acoustic wave sensor 2' are configured in such a manner that they can be arranged directly beside one another even if they are read at the same time. This is ensured by virtue of the fact that the signals associated with the identification parameters or the operating state parameters do not overlap in terms of time when simultaneously reading the sensors 2, 2', that is to say when the sensors are read using a single antenna 4 for example. The surface acoustic wave sensors 2 and 2' each have a receiving/transmitting unit in the form of sensor antennas 5. These sensor antennas 5 are each connected to a signal converter 7 in the case of the two sensors 2 and 2'. In both cases, the signal converter 7 is a metallic finger structure which is suitable for converting the electromagnetic signals transmitted by the antenna of the reading device and received by the sensor antennas 5 into surface acoustic waves. For this purpose, the signal converter 7 is arranged on a piezoelectric crystal 6. The latter only allows the electromagnetic signals received by the sensor antennas 5 to be converted into surface acoustic waves which propagate on the surface of the crystal 6.

The surface acoustic waves generated by the signal converter 7 propagate in a manner perpendicular to the fingers of the signal converter 7. The first surface acoustic wave sensor 2 in FIG. 4 has a first reflector 8 for reflecting surface acoustic waves and a second reflector 9 for reflecting surface acoustic waves. The reflectors 8 and 9 are arranged at a particular distance from the signal converter 7 and are designed in such a manner that they at least partially reflect the surface acoustic waves propagating from the signal converter 7 in the direction of the reflectors 8 and 9. In this case, the reflectors 8 and 9 are arranged behind one another. As a result of the distance between the reflectors 8 and 9 and the signal converter 7 or between the reflectors 8 and 9 themselves, the first surface acoustic wave sensor 2 has an identity parameter which can be uniquely associated with this sensor 2. The sensor 2' illustrated in FIG. 5 differs from the sensor 2 illustrated in FIG. 4 only in that the arrangement of the reflectors 8' and 9' on the piezoelectric crystal 6 relative to the signal converter 7 of the sensor 2' differs from the arrangement of the reflectors 8 and 9 relative to the signal converter 7 of the sensor 2. In particular, however, the reflectors 8, 9 and 8', 9' of the sensors 2 and 2' are arranged in such a manner that, when simultaneously reading the sensors 2 and 2', the propagation times of the surface acoustic waves from the signal converter 7 of the first sensor 2 to the reflector 8 or 9 and back to the signal converter 7 or from the signal converter 7 of the second sensor 2' to the reflector 8' or 9' and back differ in such a manner that the signals or the signal response from the first surface acoustic wave sensor 2 and the signals or the signal response from the second surface acoustic wave sensor 2' do not overlap. Therefore, the sensors 2 and 2' in the immediate vicinity of one another may be operated by the same or different rollers, for example.

At the same time, the amount of effort needed to read the sensors is reduced in this case. Since the propagation time of the surface acoustic waves from the respective signal converter to the reflectors 8 and 9 or 8' and 9' is temperature-dependent and also dependent on the oscillation state of the piezoelectric crystal which is directly coupled to the roller, identification parameters and operating state parameters are read together in the surface acoustic wave sensors 2 and 2'. It is thus possible to easily detect the temperature and the oscillation state by calibrating the surface acoustic wave sensors 2 and 2' once. In order to detect the oscillation state, an additional component which is based on a semiconductor material and is designed to detect oscillations may be provided. This is preferably connected to the surface acoustic wave sensor 2 or 2' and can advantageously be read together with the latter.

The invention claimed is:

1. A system for changing a roller of an industrial installation, comprising a system for determining parameters regarding the roller, at least one sensor arranged on the roller, the at least one sensor storing at least one identity parameter of the roller, the at least one identity parameter comprising information that allows unique identification of the roller, and a reading device configured to contactlessly read the at least one identity parameter from the sensor, and a roller changing carriage configured to mount the roller for insertion into or removal from a particular rolling stand, and a data evaluation device configured to:

receive the at least one identity parameter of the roller from the reading device, and automatically determine, based on the at least one identity parameter of the roller, whether the roller is suitable for a planned operation on the particular rolling stand.

2. The system of claim 1, wherein the reading device is arranged on the roller changing carriage.

3. The system of claim 1, wherein the roller changing carriage comprises a gripper carriage on which the reading device is arranged.

4. The system of claim 1, wherein the at least one sensor is arranged on an end face of the roller or on a bearing of the roller.

5. The system of claim 1, wherein the data evaluation device is configured to determine whether the roller is compatible with a particular product to be manufactured on the particular rolling stand.

6. The system of claim 1, wherein the at least one sensor is configured to measure at least one operating state parameter of the roller.

7. The system of claim 6, wherein an operating state parameter is the temperature of the roller.

8. The system of claim 1, wherein the at least one sensor is configured to detect at least one of an oscillation frequency and an oscillation amplitude of the roller.

9. The system of claim 1, wherein the reading device can supply energy to the sensor for operating the sensor.

10. The system of claim 1, wherein the reading device is configured to read the at least one identity parameter from the sensor using electromagnetic radiation.

11. The system of claim 1, wherein the sensor configured to detect a plurality of parameters together.

12. The system of claim 11, wherein the sensor comprises at least one reflector configured to determine the at least one identify parameter.

13. The system of claim 11, wherein a first roller has a first surface acoustic wave sensor and a second roller has a second surface acoustic wave sensor, wherein reflectors of the first and second surface acoustic wave sensors are arranged such that signals associated with the parameters from the first roller and the second roller do not overlap in time when simultaneously reading the sensors.

14. A method for changing a roller of an industrial installation, comprising the steps of:

storing at least one identity parameter of the roller in at least one sensor arranged on the roller, the at least one identity parameter comprising information that allows unique identification of the roller, contactlessly reading the at least one identity parameter from the at least one sensor, and operating a roller changing carriage configured to mount the roller for insertion into or removal from a particular rolling stand, and automatically determining, based on the at least one identity parameter read from the roller, whether the roller is suitable for a planned operation on the particular rolling stand.

15. The method according to claim 14, further comprising determining whether the roller is compatible with a particular product to be manufactured on the particular rolling stand.

16. The method according to claim 14, further comprising using the at least one sensor to measure at least one operating state parameter of the roller.

17. The method according to claim 14, further comprising the reading device supplying energy to the sensor for operating the sensor.

18. A system for changing a roller of an industrial installation, comprising a system for determining parameters regarding the roller, at least one sensor arranged on the roller, the at least one sensor configured to detect or store at least one an identity parameter of the roller, the at least one identity parameter comprising information that allows unique identification of the roller, a reading device configured to read at least one of the identity parameter and the operating state parameter from the sensor, and a roller changing carriage configured to mount the roller for insertion into or removal from a particular rolling stand, wherein the at least one sensor is arranged on an end face of the roller or on a bearing of the roller.

19. A system for changing a roller of an industrial installation, comprising a system for determining parameters regarding the roller, a sensor arranged on the roller and configured to detect at least one of an oscillation frequency and an oscillation amplitude of the roller, a reading device configured to read at least one of the identity parameter and the operating state parameter from the sensor, and a roller changing carriage configured to mount the roller for insertion into or removal from a particular rolling stand.

20. The system of claim 19, wherein the at least one sensor is arranged on an end face of the roller or on a bearing of the roller.

* * * * *